US007967618B2

(12) United States Patent
Chang

(10) Patent No.: US 7,967,618 B2
(45) Date of Patent: Jun. 28, 2011

(54) MEMORY CARD CONNECTOR

(75) Inventor: Wen Chang Chang, Keelung (TW)

(73) Assignee: Lotes Co., Ltd., Keelung (TW)

( * ) Notice: Subject to any disclaimer, the term of this patent is extended or adjusted under 35 U.S.C. 154(b) by 12 days.

(21) Appl. No.: 12/646,027

(22) Filed: Dec. 23, 2009

(65) Prior Publication Data

US 2011/0081797 A1 Apr. 7, 2011

(30) Foreign Application Priority Data

Oct. 1, 2009 (CN) ..... 2009 2 0178548 U

(51) Int. Cl.
*H01R 13/62* (2006.01)

(52) U.S. Cl. ..... 439/157

(58) Field of Classification Search ..... 439/157, 439/159, 160, 152–156, 325, 326, 329, 327, 439/328

See application file for complete search history.

(56) References Cited

U.S. PATENT DOCUMENTS 5,074,800 A * 12/1991 Sasao et al. ..... 439/157
5,429,523 A * 7/1995 Tondreault ..... 439/157
5,443,394 A * 8/1995 Billman et al.
5,445,531 A * 8/1995 Billman et al. ..... 439/160
5,470,242 A * 11/1995 Cheng et al.
5,558,528 A * 9/1996 Cheng et al.
5,634,803 A * 6/1997 Cheng et al.
5,662,485 A * 9/1997 Yip et al.
5,672,069 A * 9/1997 Cheng et al.
5,690,499 A * 11/1997 Howell et al.
6,200,149 B1 * 3/2001 Chi-Chung
6,599,142 B2 * 7/2003 Bu
6,702,598 B1 * 3/2004 Lo
6,824,407 B1 * 11/2004 Zhao et al.
7,004,773 B1 * 2/2006 Poh et al. ..... 439/160
7,371,007 B2 * 5/2008 Nilsson ..... 378/207
2004/0175980 A1 * 9/2004 Poh et al.
2007/0032117 A1 * 2/2007 Huang et al.

* cited by examiner

*Primary Examiner* — Alexander Gilman
(74) *Attorney, Agent, or Firm* — Rosenberg, Klein & Lee

(57) ABSTRACT

A memory card connector is used for being plugged with a memory card. The memory card connector includes an insulating body having a plugging slot and two pivoting bases, two locking parts, and a plurality of conducting pins received in the insulating body. The memory card is plugged into the plugging slot. The two pivoting bases are respectively located at two sides of the insulating body. The pivoting base that is close to the plugging slot has a blocking portion. The two locking parts are respectively pivoted with the two pivoting bases for holding the memory card and can be entered by the blocking portion. The total height of the memory card connector is reduced. The required space for packaging and shipping the memory card connector is reduced to lower the shipping cost.

20 Claims, 8 Drawing Sheets

MEMORY CARD CONNECTOR

BACKGROUND OF THE INVENTION

1. Field of the Invention

The present invention relates to a memory card connector. In particular, the present invention relates to a DDR3 memory card connector that its total height is reduced.

2. Description of Related Art

The memory card connector of the prior art includes an insulating body, a plurality of conducting pins fastened in the insulating body, and a pair of locking devices located at two ends of the insulating body.

The insulating body includes a plug slot and a pair of tower portions, which are located at two opposite sides of the plug slot. Two opposite guiding walls are located under the tower portions and a concave trough is formed between the guiding walls. Each of the guiding walls has a pivoting hole. A position-limit portion is located on the tower portion, and two sides of the position-limit portion respectively have a wedging trough.

The locking device includes a base body and a head portion. The base body is movably received in the concave trough. The head portion extends upwards from the base body. The base body has a pivoting shaft. The pivoting shaft is rotatably pivoted in the pivoting hole. Two sides of the head portion respectively extend to form a holding portion toward the plug slot. The holding portion matches the wedging trough of the position-limit portion. The wedging trough prevents the holding portion from rotating in the direction facing to the plug slot.

The memory card connector has the following drawbacks.

1. The memory card connector is soldered on a mother board. A reflow oven is used for soldering the conducting pins on the mother board. The reflow oven includes a transmission table and a heater above the transmission table. Firstly, the mother board is placed on the transmission table. Next, the memory card connector is placed on a target location of the mother board. The heater is located above the memory card connector. Because the wedging trough prevents the holding portion from rotating in the direction facing to the plug slot, the total height of the memory card connector increases. The heater is far away from the mother board. Therefore, the temperature of the soldering location between the soldering portion and the memory card connector is inadequate. The heating is unstable, or heating is not uniform. The soldering effect is poor.

2. Because the total height of the memory card connector increases, the required space is also increased when the memory card connector is packaged and shipped. The shipment cost increases.

3. Because a lot of the memory card connectors are soldered on the mother board and the space of the mother board is limited, the gap between the memory card connectors is small. Moreover, the holding portion matches the wedging trough of the position-limit portion and the wedging trough prevents the holding portion from rotating in the direction facing to the plug slot, the height in the vertical direction or the length in the lengthwise direction increases. It is not easy to install another row of the memory card connectors, and it is easy to damage the other elements.

SUMMARY OF THE INVENTION

One particular object of the present invention is to provide a memory card connector that its total height is reduced. The memory card connector can be easily packaged and shipped.

The memory card connector is used for receiving a memory card plugged therein. The memory card connector includes an insulating body having a plugging slot and two pivoting bases, two locking parts, and a plurality of conducting pins received in the insulating body. The memory card is plugged into the plugging slot. The two pivoting bases are respectively located at two sides of the insulating body. The pivoting bases respectively have a blocking portion adjacent to the plugging slot. The two locking parts are respectively pivoted with the two pivoting bases for holding the memory card. When the memory card is plugged into the plugging slot, the holding portion locks the memory card, and the locking parts are in a vertical status. When the memory card is taken away from the plugging slot, the locking part is rotated in a direction away from the plugging slot, and the locking part is an outer-folding status. The locking part rotates toward the plugging slot from in the vertical status to make the blocking portion enter, and the locking part is in an inner-folding status.

The memory card connector of the present invention is soldered on a mother board by a reflow oven. The reflow oven includes a transmission table and a heater on the transmission table. Firstly, the mother board is placed on the transmission table. Next, the memory card connector is placed on the target location on the mother board. The heater is located above the memory card connector. Because the locking part rotates toward to the plugging slot from in the vertical status to make the blocking portion enter, the total height of the memory card connector is reduced. Thereby, the heater is close to the mother board so that the temperature of the soldering location between the conducting pins and the mother board is adequate and stable. The soldering effect is good.

Furthermore, because the total height of the memory card connector is reduced, the required space for packaging and shipping the memory card connector is also reduced. The shipment cost is reduced.

Because a lot of the memory card connectors are soldered on the mother board and the space of the mother board is limited, the gap between the memory card connectors is small. However, because the locking part rotates towards the plugging slot from the vertical status to make the locking part enter, the height of the memory card connector in the vertical direction is reduced and the length in the longwise direction is not increased. It is easy to install another row of the memory card connectors, and the other elements are not damaged.

For further understanding of the present invention, reference is made to the following detailed description illustrating the embodiments and examples of the present invention. The description is for illustrative purpose only and is not intended to limit the scope of the claim.

DETAILED DESCRIPTION OF THE PREFERRED EMBODIMENTS

Figure 1:
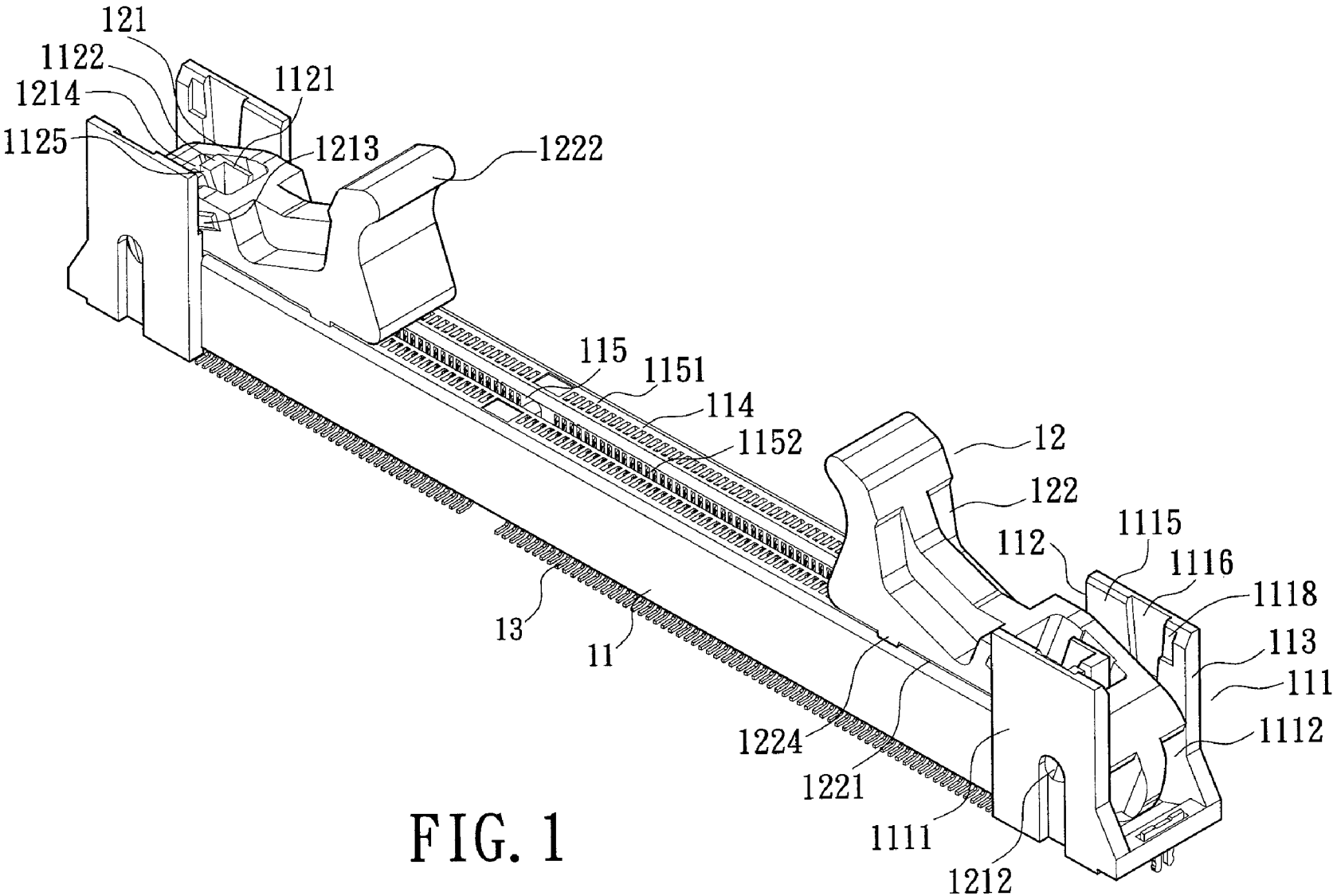
FIG. 1 is an assembly perspective view of the memory card connector of the present invention.

Reference is made to FIG. 1. The memory card connector 1 of the present invention includes a lengthwise insulating body 11, a plurality of conducting pins 13 received in the insulating body 11, and two locking parts 12 pivoted at two sides of the insulating body 11.

Figure 6:
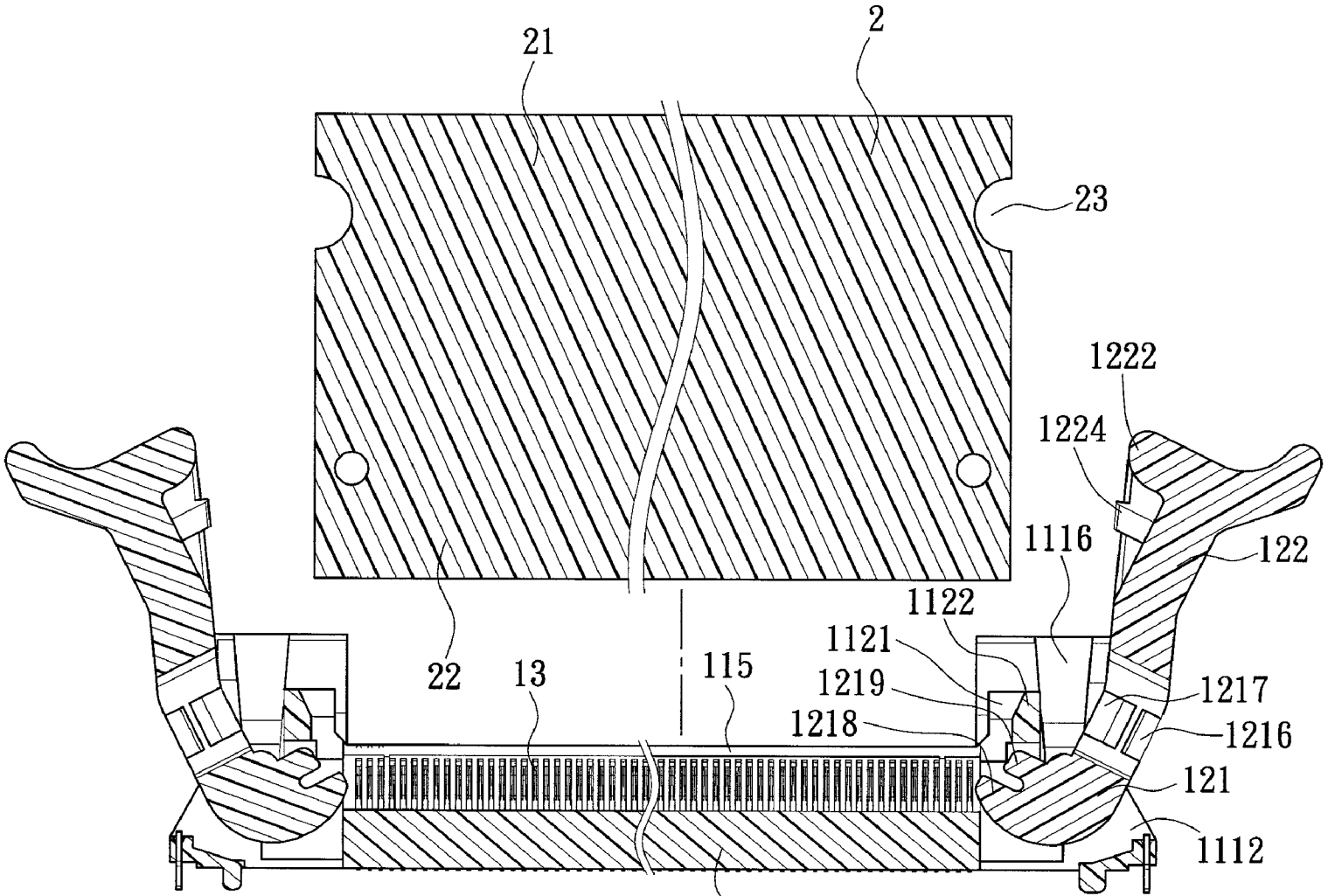
FIG. 6 is a cross-sectional diagram of FIG. 5.
Figure 7:
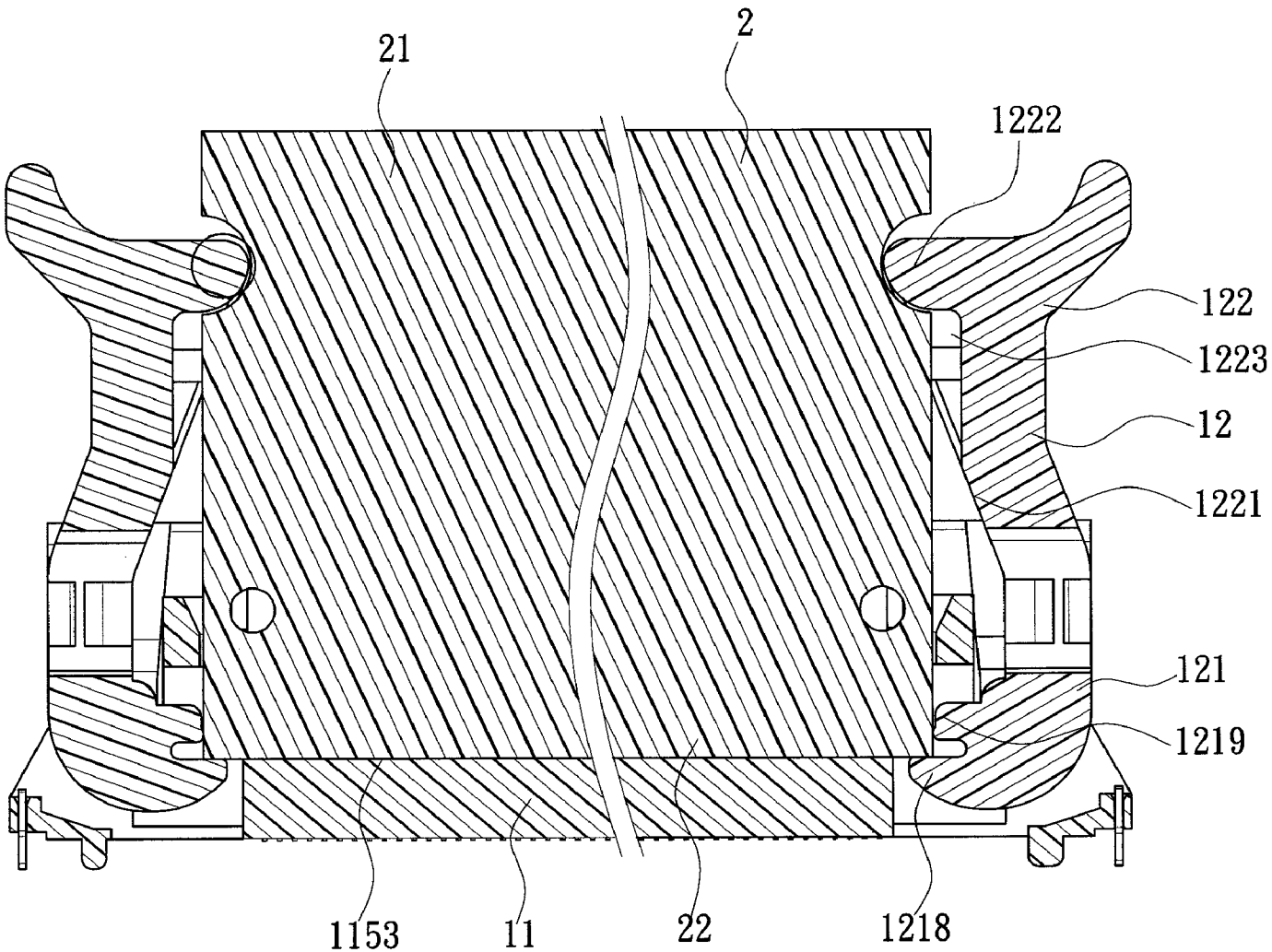
FIG. 7 is a cross-sectional diagram of the memory card being plugged into the memory card connector of the present invention.

Reference is made to FIGS. 1 and 6. The insulating body 11 has a pair of pivoting bases 111 located at two sides of the insulating body 11. Each of the pivoting bases 111 has an inner side wall 112 and an outer side wall 113. The gap between the two inner side walls 112 is shorter than the gap between the two outer side walls 113. Moreover, the insulating body 11 further has a pair of wall portions 114, a center plugging slot 115 formed between the two wall portions 114, and a horizontal connection surface 1151. The plugging slot 115 has two inner side surfaces 1152 and a bottom surface 1153, and its opening is located on the horizontal connection surface 1151.

Figure 3:
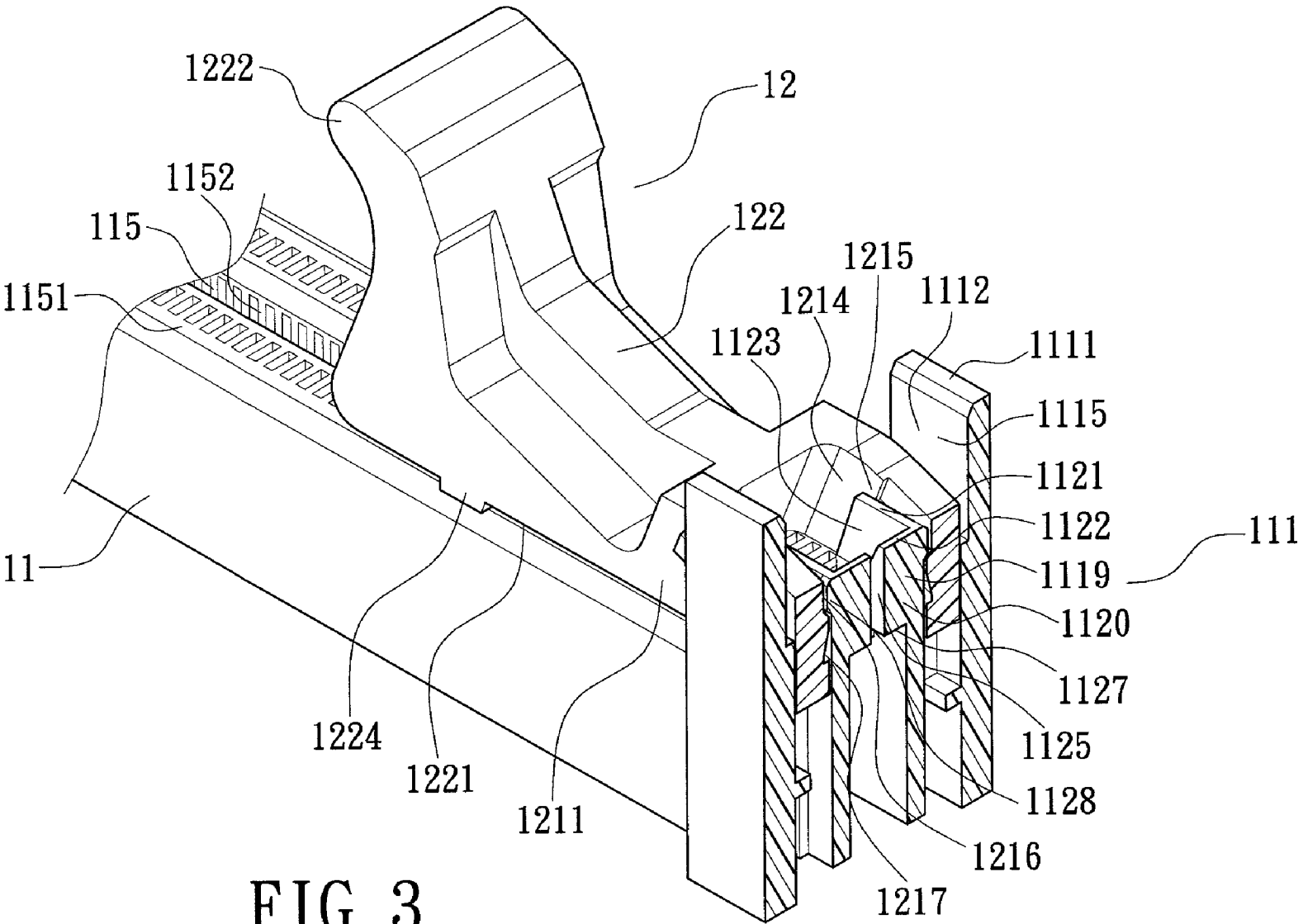
FIG. 3 is a cross-sectional diagram of part of the insulating body matched with the locking part in the memory card connector of the present invention.
Figure 4:
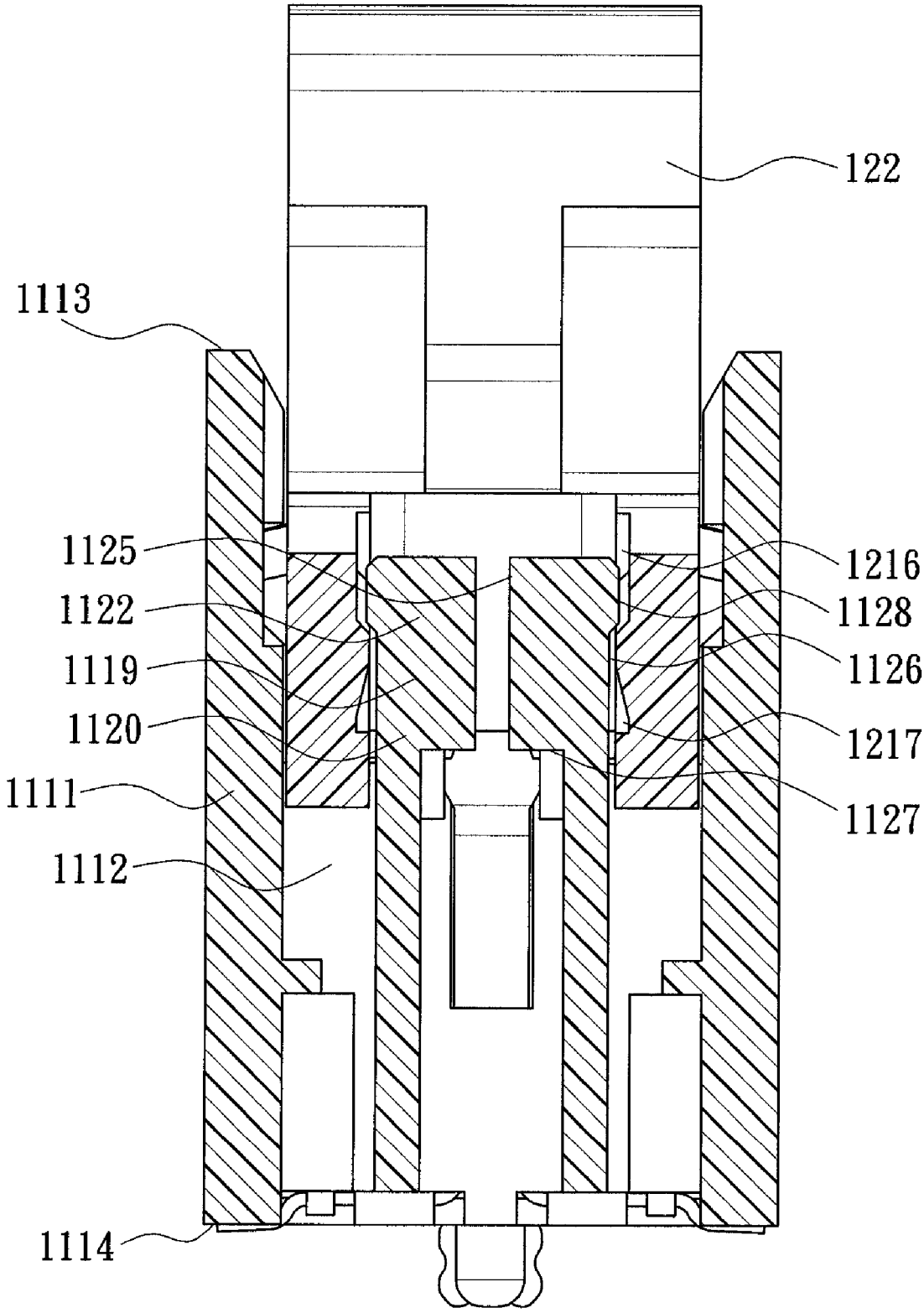
FIG. 4 is a front view of FIG. 3.

Reference is made to FIGS. 1 and 3. The pivoting bases 111 are integrally formed at the opposite ends of the insulating body 11 into one piece. Each of the pivoting bases 111 has two guiding walls 1111. A concave trough 1112 is formed between the two guiding walls 1111. The concave trough 1112 is linked with the plugging slot 115 of the insulating body 11. The two guiding walls 1111 respectively have an upper surface 1113, a lower surface 1114, and an inner surface 1115. There is a guiding trough 1116 formed concavely on the inner surface 1115. The guiding trough 1116 passes through the upper surface 1113 upwardly, and becomes narrow from the upper side to the lower side. Each of the guiding walls 1111 has a pivoting hole 1117 adjacent to the lower surface 1114. The pivoting hole 1117 is located at an rear end of the guiding trough 1116. There is a cutout 1118, which is formed on the inner surface 1115 and is close to the upper surface 1113 and the outer side wall 113. Only one side of the cutout 1118 is linked with the guiding trough 1116.

Figure 2:
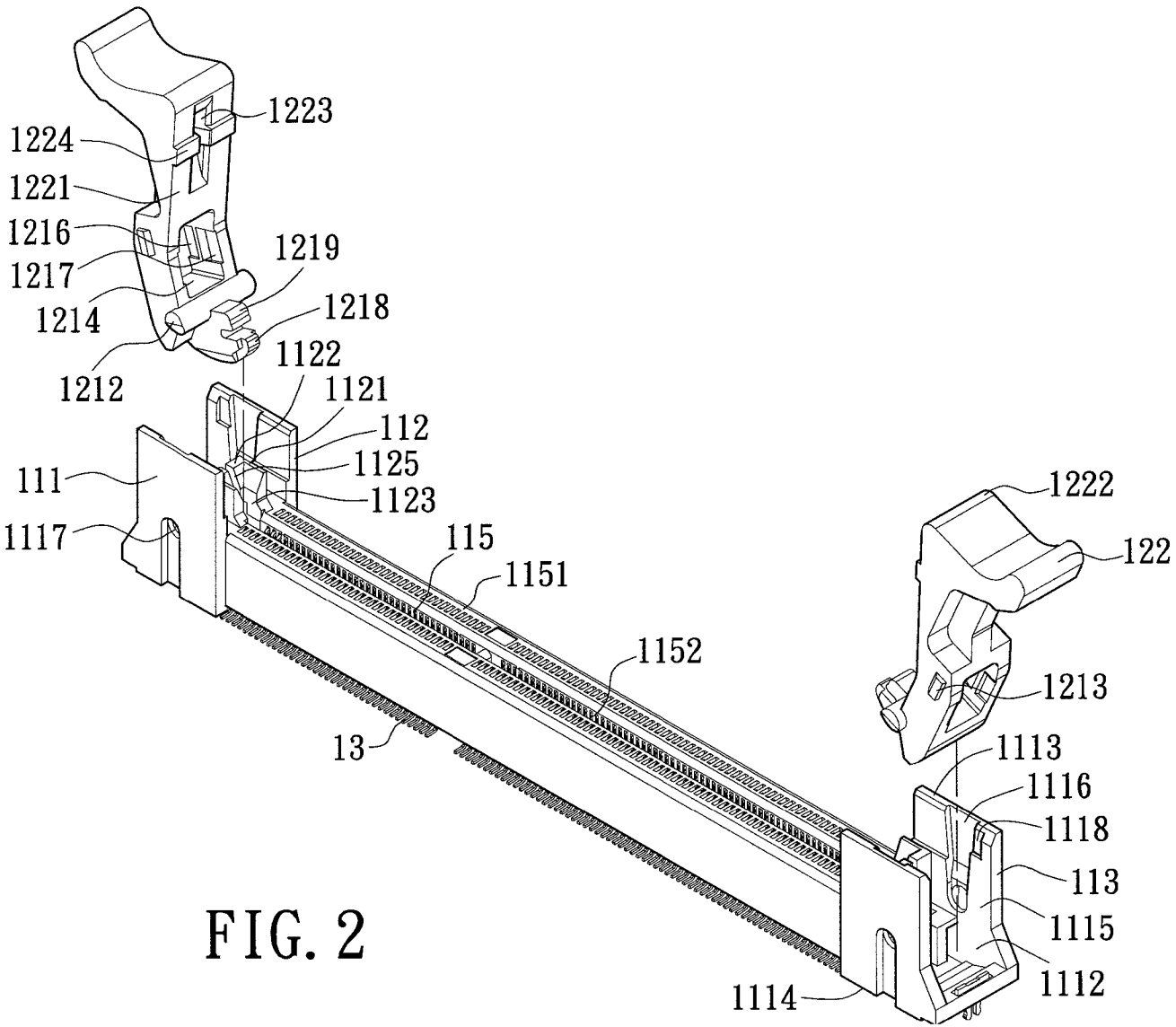
FIG. 2 is an exploded perspective view of the insulating body and the locking part of the memory card connector of the present invention.

The pivoting base 111 has a blocking portion 1119 that is close to the inner side wall 112. The blocking portion 1119 includes a pair of flexible arms 1120 formed oppositely. Two flexible arms 1120 respectively have a narrow portion 1121 and a wide portion 1122 (as shown in FIG. 2). The narrow portion 1121 is close to the inner side wall 112, and the wide portion is far away from the inner side wall 112. The two narrow portions 1121 respectively have a first inner side wall 1123 and a first outer side wall 1124. The two wide portions 1122 respectively have a second inner side wall 1125 and a second outer side wall 1126 which are formed oppositely. The two first inner side walls 1123 are aligned to the inner side surface 1152 of the plugging slot 115. The first outer side wall 1124 and the second outer side wall 1126 have the same surface. The gap between the two first inner side walls 1123 is larger than the gap between the two second side walls 1125, which means that the gap between the narrow potions 1121 is larger than the gap between the wide portions 1122.

The lower end of the two flexible arms 1120 respectively has a leaning portion 1127. The two outer side walls 1124 respectively have a wedging point 1128.

Reference is made to FIGS. 1 and 3. The locking part 12 has a base body 121 and a head portion 122 located at the top of the base body 121. The base body 121 has two third outer side walls 1211. Each of the third outer side walls 1211 has a pivoting shaft 1212. The pivoting shaft 1212 is pivotally received in the pivoting hole 1117 and can be rotated. The two third outer side walls 1211 respectively have a convex point 1213. The concave point 1213 matches with the cutout 1118.

The locking part 12 has a lengthwise opening trough 1214 formed on the base body 121, and two third inner side walls 1215 formed oppositely in the opening trough 1214. The two third inner side walls 1215 respectively have a first wedging trough 1216 and a second wedging trough 1217. The first wedging trough 1216 is adjacent to the second wedging trough 1217 and both are wedged with the wedging point 1128. One side of the head portion 122 that is close to the plugging slot 115 has a slanted surface 1221. The top of the slanted surface 1221 has a holding portion 1222. A holding trough 1223 is formed concavely on the slanted surface 1221. Two sides of the holding trough 1223 respectively have a supporting portion 1224. The lower end of the base body 121 has a push portion 1218. The top of the push portion 1218 has a position-limit portion 1219.

Figure 5:
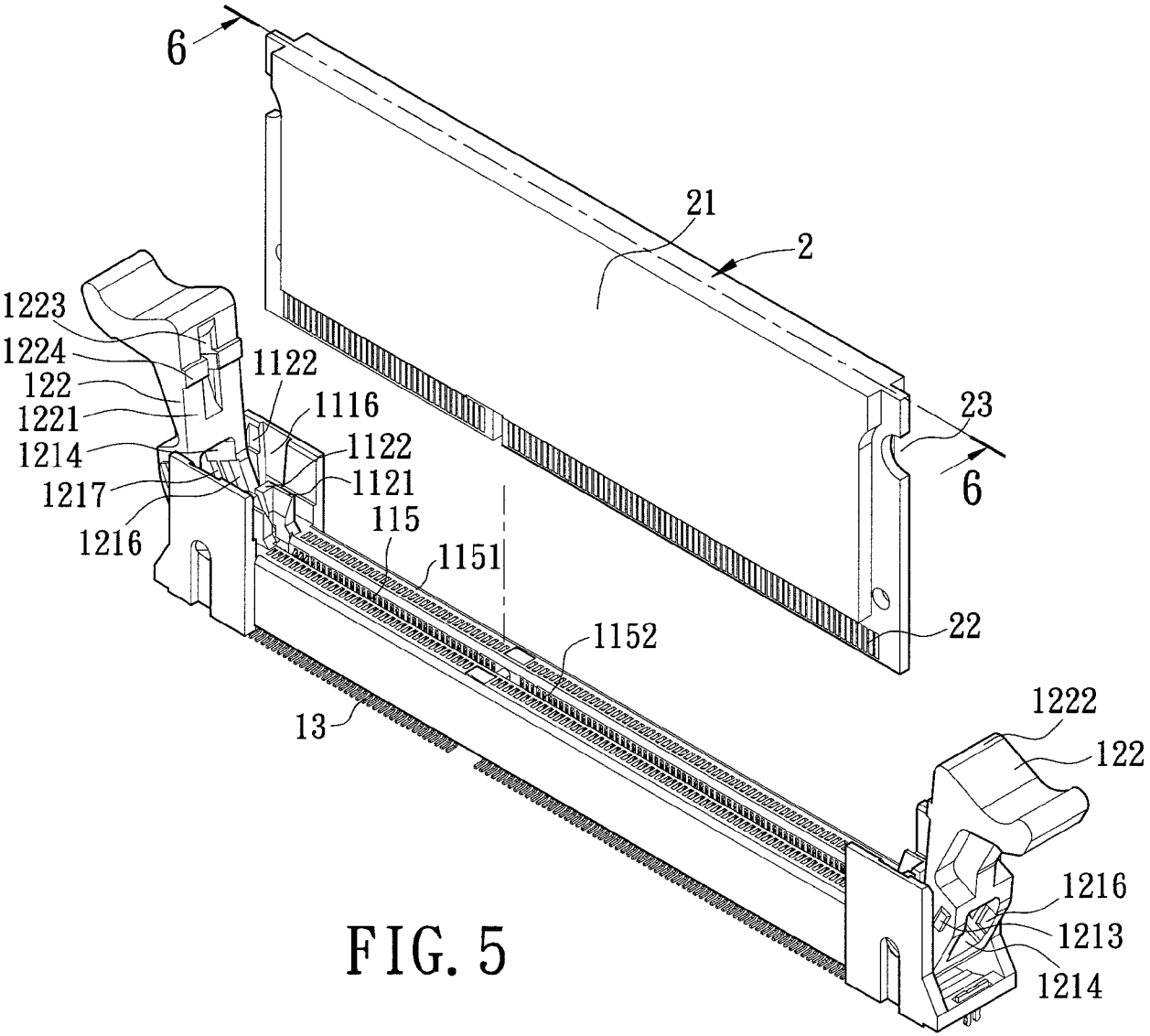
FIG. 5 is an assembly perspective view of the memory card connector and the memory card of the present invention.
Figure 8:
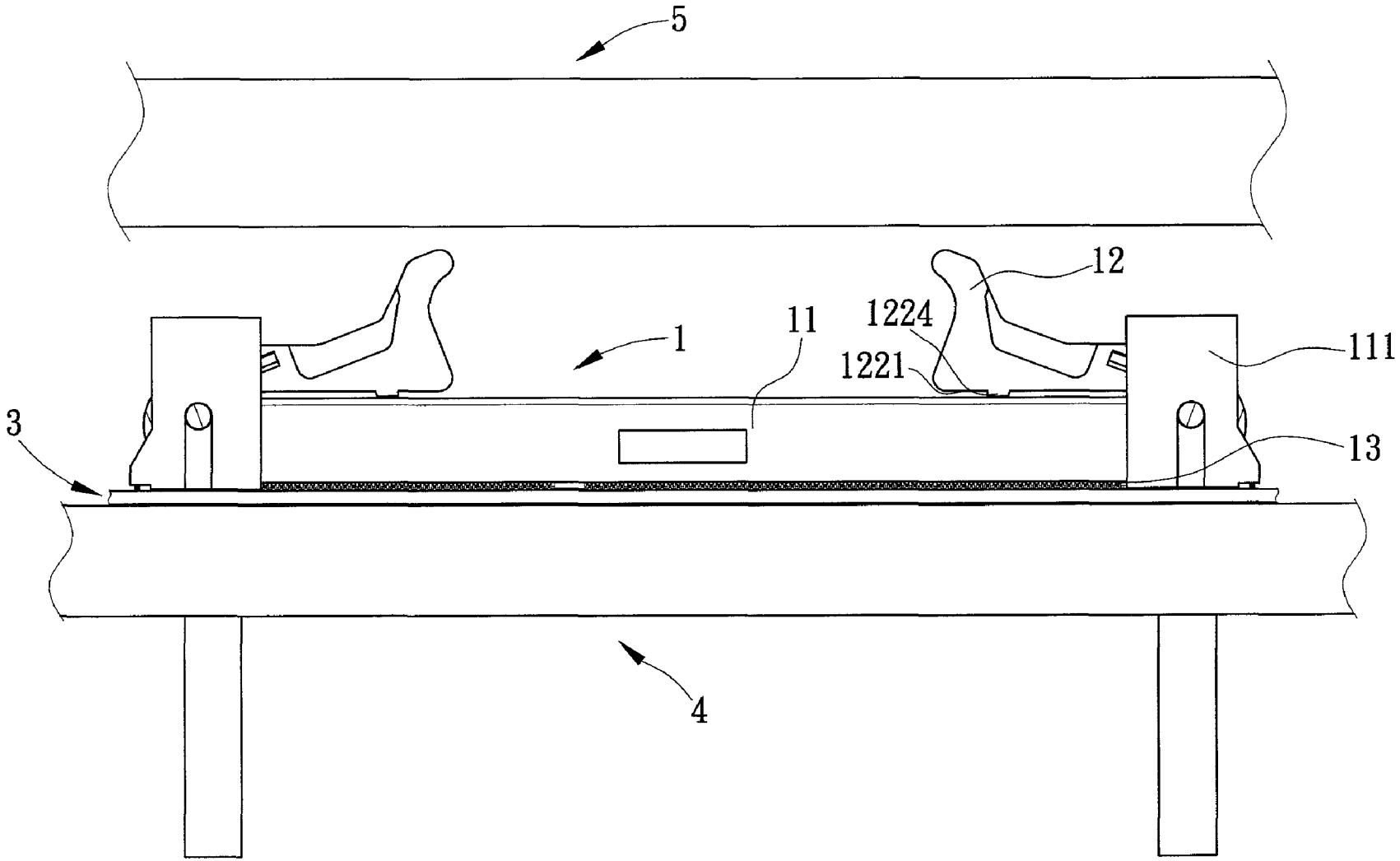
FIG. 8 is a schematic diagram of the memory card connector of the present invention and the mother board being soldered in the reflow oven.

Concerning the operation, reference is made to FIGS. 5 and 8. The memory card connector 1 is used for receiving a memory card 2 plugged therein. The memory card connector 1 is soldered on a mother board 3, and the memory card 2 is plugged into the memory card connector 1 so that the memory card 2 is electrically connecting with the mother board 3. The memory card 2 includes a body portion 21 and a plugging portion 22 extended downwardly from the body portion 21. Two sides of the body portion 21 respectively have has a holding through 23. The holding trough 23 is wedged with the holding portion 1222. In this embodiment, the memory card connector 1 and the mother board 3 are soldered in a reflow oven. The reflow oven includes a transmission table 4, at least one heater 5 located above the transmission table 4, and a cover body (not shown in the figure) for covering the transmission table 4 and the heater 5.

Firstly, a plurality of conducting pins 13 are respectively installed into the two wall portions 114 of the insulating body 11. Part of the conducting pin 13 enters into the plugging slot 115, and part of the conducting pin 13 exposes to outside of the bottom of the insulating body 11.

Next, the locking part 12 is installed on the pivoting base 111 of the insulating body 11 from top to down. The pivoting shaft 1212 of the base body 121 slides downwardly into the pivoting hole 1117 via the guiding trough 1116. The push portion 1218 and the position-limit portion 1219 are located below the leaning portion 1127 of the blocking portion 1119. The third outer side wall 1211 of the base body 121 is adjacent to the inner surface 1115 of the guiding wall 1111. The third inner wall 1215 of the opening trough 1214 is adjacent to the first outer side wall 1124 of the flexible arm 1120. The slanted surface 1221 of the head portion 122 faces to the plugging slot 115.

Next, the memory card connector 1 is soldered on the mother board 3. The mother board 3 is placed on the transmission table 4. The conducting pins 13 of the memory card connector 1 are placed on the target location of the mother board 3. The heater 5 is located above the memory card connector 1. At this time, the locking part 12 is rotated toward the plugging slot 115 from the vertical status so that the total height of the memory card connector 1 is reduced.

Finally, the memory card 2 is installed into the insulating body 11 of the memory card connector 1 soldered on the mother board 3. The plugging portion 22 is plugged into the plugging slot 115 via the connection surface 1151. The plugging portion 22 contacts the conducting pin 13. The bottom of the plugging portion 22 contacts the bottom surface 1153 of the plugging slot 115. The memory card 2 enters into the gap between the two narrow portions 1121.

When the memory card 2 is plugged into the plugging slot 115, the locking part 12 locks the memory card 2. At this time, the locking part 12 is in a vertical status. The memory card 2 pushes the push portion 1218. The push portion 1218 leans against the lower side of the plugging portion 22. One side of the position-limit portion 1219 leans against two sides of the memory card 2. The holding portion 1222 is wedged into the holding trough 23. Part of two ends of the memory card 2 enters into holding trough 1223. The cutout 1118 prevents the convex point 1213 from rotating away from the plugging slot 115. When the locking part 12 rotates to a predetermined position relative to the pivoting bases 111, the top of the locking part 12 is located at the highest location relative to the pivoting bases 111, which is also the vertical status. The above structure is used for stably holding the memory card 2 in the memory card connector 1.

When the memory card 2 is taken away from the plugging slot 115, the locking part 12 rotates in a direction that is away from the plugging slot 115. At this time, the locking part 12 is in an outer-folding status. The convex point 1213 crosses over the cutout 1118. The push portion 1218 pushes the lower side of the plugging portion 22 so that the position-limit portion 1219 leans against the leaning portion 1127 of the flexible arm 1120. Thereby, the leaning portion 1127 prevents the locking part 12 from rotating in the direction from the plugging slot 115. The above structure is used for taking off the memory card 2 easily.

When the locking part 12 rotates toward the plugging slot 115 from the vertical status, the head portion 122 is located above the plugging slot 115. At this time, the locking part 12 is in an inner-fold status. During the locking part 12 rotates from the outer-fold status to the vertical status, the convex point 1213 is blocked at the outer side wall 113, and then enters into the cutout 1118. Next, the wedging points 1128 of the two flexible arms 1120 enter into the two second wedging troughs 1217 of the opening trough 1214. The second wedging trough 1217 is used for blocking the locking part 12 from rotating toward the plugging slot 115. Next, the wedging point 1128 crosses over the second wedging trough 1217 and enters into the first wedging trough 1216. Finally, the locking part 12 continuously rotates toward the plugging slot 115 so that the head portion 122 enters into the upper area of the plugging slot 115. The support portion 1224 leans against the connection surface 1151. At this time, the slanted surface 1221 is parallel to the connection surface 1151.

When the locking part 12 rotates from the inner-fold status to the vertical status, the wedging point 1128 enters into the first wedging trough 1216. The first wedging trough 1216 prevents the locking part 12 from rotating in a direction away from the plugging slot 115.

The memory card connector of the present invention has the following characteristics.

1. Because the locking part can be rotated to the plugging slot from the vertical status to make the blocking portion enter, the total height of the memory card connector is reduced. Thereby, the heater is closer to the mother board to assure that the soldering temperature between the conducting pins and the mother board is adequate and stable. The soldering effect is good.

2. Because the total height of the memory card connector is reduced, the required space for packaging and shipping the memory card connector is also reduced. The shipping cost is lowered.

3. When the memory card is plugged into the plugging slot, the cutout blocks the convex point from rotating toward a direction away from the plugging slot so that the locking part stably holds the memory card in the plugging slot. The memory card is not easily escaped from the plugging slot. The memory card is conducted with the mother board well.

4. When the support portion leans against the connection surface of the insulating body, the locking part cannot rotate to the vertical status due to the first trough of the opening trough blocks the wedging point of the flexible arm. Thereby, the locking part cannot arbitrarily rotate on the pivoting base so that the memory card connector cannot be easily damaged.

5. The slanted surface of the locking part has the support portion. When the locking part is rotated toward the inner-fold status to a predetermined position, the support portion leans against the connection surface of the insulating body and the slanted surface is parallel to the connection surface. Therefore, the wedging portion does not need to directly lean against the connection surface to prevent the wedging portion from being worn. When the memory card is plugged into the plugging slot, the wedging portion is wedged into the wedging trough to hold the memory card in the memory card connector stably.

6. Because a lot of the memory card connectors are soldered on the mother board and the space of the mother board is limited, the gap between each of the memory card connectors is small. However, because the locking part rotates toward the plugging slot from the vertical status to make the locking part enter, the height of the memory card connector in the vertical direction is reduced and the length in the longwise direction is not increased. It is easy to install another row of the memory card connectors, and the other elements are not damaged.

The description above only illustrates specific embodiments and examples of the present invention. The present invention should therefore cover various modifications and variations made to the herein-described structure and operations of the present invention, provided they fall within the scope of the present invention as defined in the following appended claims.

What is claimed is:

1. A memory card connector, comprising: an insulating body having a plugging slot and two pivoting bases, wherein the two pivoting bases are respectively located at two opposite sides of the insulating body, the pivoting base extended upwardly to form a blocking portion adjacent to the plugging slot, the blocking portion having a pair of flexible arms formed oppositely and a gap formed between the two flexible arms, and the two flexible arms respectively have a wedging point formed on an outer side walls thereof; two locking parts respectively pivoted with the two pivoting bases; and a plurality of conducting pins correspondingly received in the insulating body; thereby, when the locking part rotates to a predetermined position relative to the pivoting base, a top of the locking part is located at a highest location, and when the locking part rotates from the predetermined position toward the plugging slot to be located between the predetermined position and the plugging slot, the locking parts are positioned with the two wedging points of the blocking portion.

2. The memory card connector as claimed in claim 1, wherein the locking parts have at least one opening trough for receiving the two flexible arms therein, wherein the flexible arm has a leaning portion formed at a lower end thereof, the locking part has a position-limit portion formed at a lower end thereof, and the leaning portion is blocked by the position-limit portion.

3. The memory card connector as claimed in claim 2, wherein two inner side walls of the opening trough respectively have at least one first wedging trough for matching with the wedging points, and the wedging point prevents the locking part from rotating to a direction away from the plugging slot.

4. The memory card connector as claimed in claim 2, wherein two inner side walls of the opening trough respectively have a first wedging trough and a second wedging trough, wherein the wedging point is cooperated with the second wedging trough for preventing the locking part from rotating toward the plugging slot.

5. The memory card connector as claimed in claim 1, wherein the locking part has a slanted surface formed on a side closed to the plugging slot, the slanted surface has a support portion, the support portion leans against the upper surface of the insulating body, and when the locking part rotates from the highest point toward the plugging slot to a predetermined position, the slanted surface is parallel to the upper surface of the insulating body.

6. The memory card connector as claimed in claim 1, wherein one side of the locking part close to the plugging slot has a slanted surface, and when the locking part rotates from the highest point toward the plugging slot to a predetermined position, the slanted surface and an upper surface of the insulating body form an obtuse angle.

7. The memory card connector as claimed in claim 1, wherein the width between the two flexible arms close to the plugging slot is greater than the width between the two flexible arms away from to the plugging slot, and the inner side surface of the gap close to the plugging slot is aligned with the inner side surface of the plugging slot.

8. A memory card connector, comprising: an insulating body having a plugging slot and two pivoting bases, wherein the two pivoting bases are respectively located at two opposite ends of the insulating body, and the pivoting base has a blocking portion formed adjacent to the plugging slot; a plurality of conducting pins received in the insulating body correspondingly; and two locking parts respectively pivoted with the two pivoting bases; wherein the two locking parts respectively has a support portion formed on a side thereof and close to the plugging slot, and when the locking part rotates to a predetermined position relative to the pivoting base, a top of the locking part is located at a highest location relative to the pivoting base; thereby, when rotating the locking part from the predetermined position toward the plugging slot, the support portion leans against the upper surface of the insulating body, so that the locking parts are positioned and the locking parts receive part of the blocking portion.

9. The memory card connector as claimed in claim 8, wherein one side of the locking part close to the plugging slot has a slanted surface, the support portion is protruded from the slanted surface, the support portion leans against the upper surface of the insulating body, and when the locking part rotates from the highest point toward the plugging slot to the predetermined position, the slanted surface is parallel to the upper surface of the insulating body.

10. The memory card connector as claimed in claim 9, wherein the locking part forms a holding trough on the slanted surface, the support portion further has a pair of support portions, and the two support portion are respectively located at two sides of the holding trough.

11. The memory card connector as claimed in claim 8, wherein the locking part has an opening trough for receiving the blocking portion therein, two inner side walls of the opening trough respectively have at least one first wedging trough, the two outer side walls of the blocking portion respectively have a wedging point, and the wedging point prevents the locking part from rotating to a direction away from the plugging slot.

12. The memory card connector as claimed in claim 8, wherein the locking part has an opening trough for being entered by the blocking portion, two inner side walls of the opening trough respectively have a first wedging trough and a second wedging trough, the two outer side walls of the blocking portion respectively have a wedging point, the wedging point is cooperated with the first wedging trough for preventing the locking part from rotating to a direction away from the plugging slot, and the wedging point is cooperated with the second wedging trough for preventing the locking part from rotating to a direction that is toward the plugging slot.

13. A memory card connector, for being plugged with a memory card, comprising: an insulating body having a plugging slot and two pivoting bases, wherein the memory card is plugged in the plugging slot, the two pivoting bases are respectively located at two opposite sides of the insulating body, and each of the pivoting base extends upwardly with a blocking portion adjacent to the plugging slot; two locking parts respectively pivoted with the two pivoting bases for holding the memory card; and a plurality of conducting pins received in the insulating body; wherein, when the memory card is plugged into the plugging slot, the locking part locks the memory card and the locking part is in a vertical status; wherein, when the memory card is taken away from the plugging slot, the locking part rotates in a direction away from the plugging slot and the locking part is in a outer-fold status, and the locking part folds inwardly toward the plugging slot from the vertical status to make the blocking portion enters into the locking part.

14. The memory card connector as claimed in claim 13, wherein the pivoting base has two opposite guiding walls for guiding the locking part into the pivoting base.

15. The memory card connector as claimed in claim 13, wherein inner side walls of the two guiding walls respectively have an cutout, the locking part has at least one convex point, when the memory card is plugged into the plugging slot, the opening blocks the convex point to prevent the locking part from rotating to the outer-fold status from the vertical status, and when the locking part rotates to the vertical status from the outer-fold status, the convex point is blocked by an outer side wall of the pivoting base.

16. The memory card connector as claimed in claim 13, wherein lower end of the locking part has a position-limit portion, the position-limit portion leans against the blocking portion, and wherein the locking part has an opening trough for receiving the blocking part therein.

17. The memory card connector as claimed in claim 16, wherein two inner side walls of the opening trough respectively have at least one first wedging trough, the two outer side walls of the blocking portion respectively have a wedging point, and the wedging point prevents the locking part from rotating to a direction away from the plugging slot.

18. The memory card connector as claimed in claim 16, wherein two inner side walls of the opening trough respectively have a first wedging trough and a second wedging trough, the two outer side walls of the blocking portion respectively have a wedging point, the wedging point is cooperated with the first wedging trough for preventing the locking part from rotating to a direction away from the plugging slot, and the wedging point is cooperated with the second wedging trough for preventing the locking part from rotating to a direction that is toward the plugging slot.

19. The memory card connector as claimed in claim 13, wherein lower end of the locking part has a push portion for pushing the memory card, one side of the locking part close to the plugging slot has a slanted surface, the slanted surface has a support portion, the support portion leans against the upper surface of the insulating body, and when the locking part rotates to an inner-fold status from the vertical status to a predetermined position, the slanted surface is parallel to the upper surface of the insulating body.

20. The memory card connector as claimed in claim 13, wherein the locking part has a slanted surface formed on a side thereof and closed to the plugging slot, and when the locking part rotates to an inner-fold status from the vertical status to a predetermined position, the slanted surface and the upper surface of the insulating body forms an obtuse angle.

* * * * *